United States Patent [19]

Miyakawa

[11] 4,041,299

[45] Aug. 9, 1977

[54] MULTIPLICATION APPARATUS

[75] Inventor: Nobuaki Miyakawa, Hitachi, Japan

[73] Assignee: Hitachi, Ltd., Japan

[21] Appl. No.: 671,988

[22] Filed: Mar. 30, 1976

[30] Foreign Application Priority Data

Apr. 4, 1975 Japan ..... 50-40269

[51] Int. Cl.[2] ..... G06G 7/16; G06G 7/24

[52] U.S. Cl. ..... 364/841; 364/857; 364/844; 328/145

[58] Field of Search ..... 235/194, 195, 196, 197, 235/150.2, 193; 328/145; 307/229, 230; 123/32 AE, 32 EA

[56] References Cited

U.S. PATENT DOCUMENTS

| | | | |
|---|---|---|---|
| 3,657,528 | 4/1972 | Plante | 328/145 X |
| 3,676,661 | 7/1972 | Sprowl | 328/145 X |
| 3,691,473 | 9/1972 | Boatwright | 328/145 |
| 3,736,415 | 5/1973 | Morrison | 328/145 X |
| 3,805,046 | 4/1974 | Magnussen, Jr. | 328/145 X |

*Primary Examiner*—Joseph F. Ruggiero

*Attorney, Agent, or Firm*—Craig & Antonelli

[57] ABSTRACT

A plurality of input signals to be multiplied are applied sequentially to a logarithmic time-width transformer in a form of electric analog signal in a predetermined order. The transformer converts each of the inputs into a signal having a time width in logarithmic relation with the analog value of corresponding input signal in response to the input signal to thereby provide a plurality of converted signals. Each of the converted signals is further converted into a train of pulses, the number thereof corresponding to the time width of the converted signal so as to convert the plurality of converted signals into a plural train of pulses. Each of the plural trains of pulses are applied to a counter so as to count up the number of pulses of the plural trains of pulses to thereby obtain the total amount of the time width of the plurality of counted signals. The total amount of the time width is converted into an electric value in antilogarithmic relation therewith to thereby obtain a multiplied value of the analog value of the plurality of input signals.

4 Claims, 7 Drawing Figures

MULTIPLICATION APPARATUS

The present invention relates to a multiplication apparatus for multiplying a plurality of electric analog value.

A multiplication apparatus has been designed for multiplying only two inputs, so that the more the inputs, the more the multiplication apparatus are required.

For example, in the fuel injection controller for a car, in order to adjust the amount of the fuel supplied to the engine properly, the multiplication of more than three inputs such as an atmospheric pressure, an atmospheric temperature and a temperature of the engine etc. is required, whereby more than two multiplication apparatus have been required to thereby result in the high cost and the reduction of the accuracy of the multiplied value.

It is therefore an object of this invention to provide a multiplication apparatus for multiplying a plurality of inputs simultaneously.

Another object of this invention is to provide a multiplication apparatus for multiplying more than two inputs with a high accuracy.

Another object of this invention is to provide a multiplication apparatus for providing an accurate multiplied value of inputs even when at least one of the values of the inputs is zero.

In accordance with this invention, a plurality of input analog signals are converted one by one in a predetermined order into a plurality of pulses each having time width in logarithmic relation with the analog value of the corresponding input signal. Each of the plurality of converted pulses is converted into a train of pulses in such manner that the number of pulses of the train of pulses corresponds to the time width of the corresponding converted pulse to thereby provide a plural trains of pulses. The number of pulses of each of the plural train of pulses is added so as to obtain the total number of pulses of the plural trains of pulses. Further, the total number of the plural trains of pulses is converted into an electric value in antilogarithmic relation therewith to thereby obtain a multiplied value of the analog value of the plurality of input signals. Therefore, in the multiplication apparatus according to this invention, no modification in the principal part of the multiplication apparatus is required even when the number of input signals increases, so that the cost thereof is maintained in spite of the increase of the number of input signals. Further, the addition of the value each in logarithmic relation with the value of the corresponding input is effected by the addition of the number of pulses of the plural trains of pulses, which results in the high accuracy of the multiplied value.

The present invention will be apparent from the following detailed description taken in conjunction with the accompanying drawings, in which.

Figure 3:
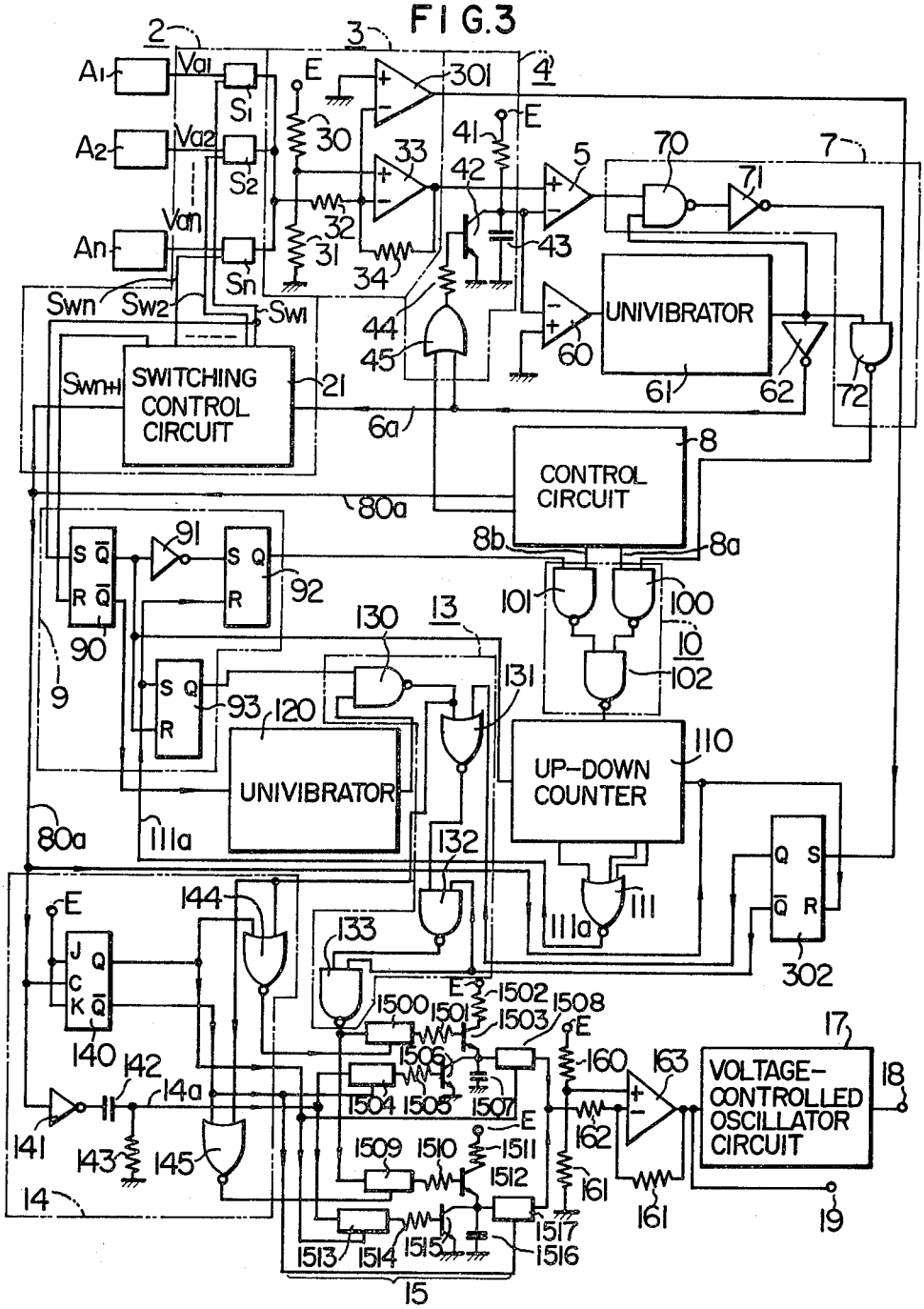
FIG. 3 is a diagram showing the details of the embodiment shown in FIG. 4.
Figure 4:
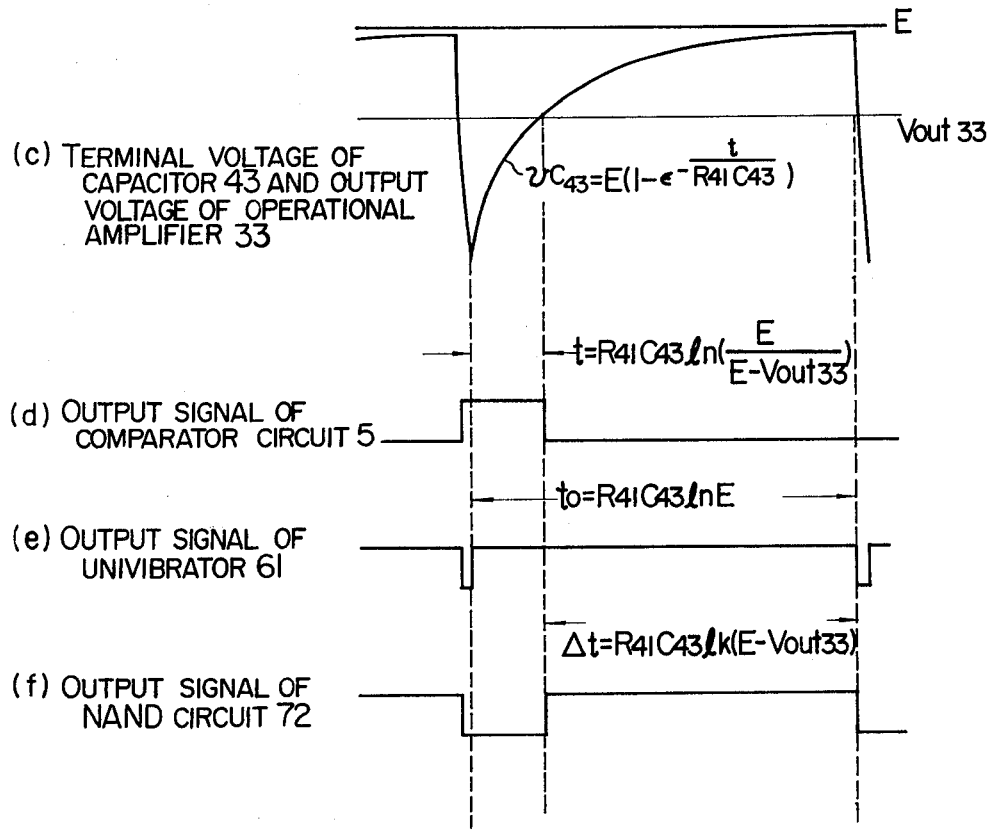
Figure 5:
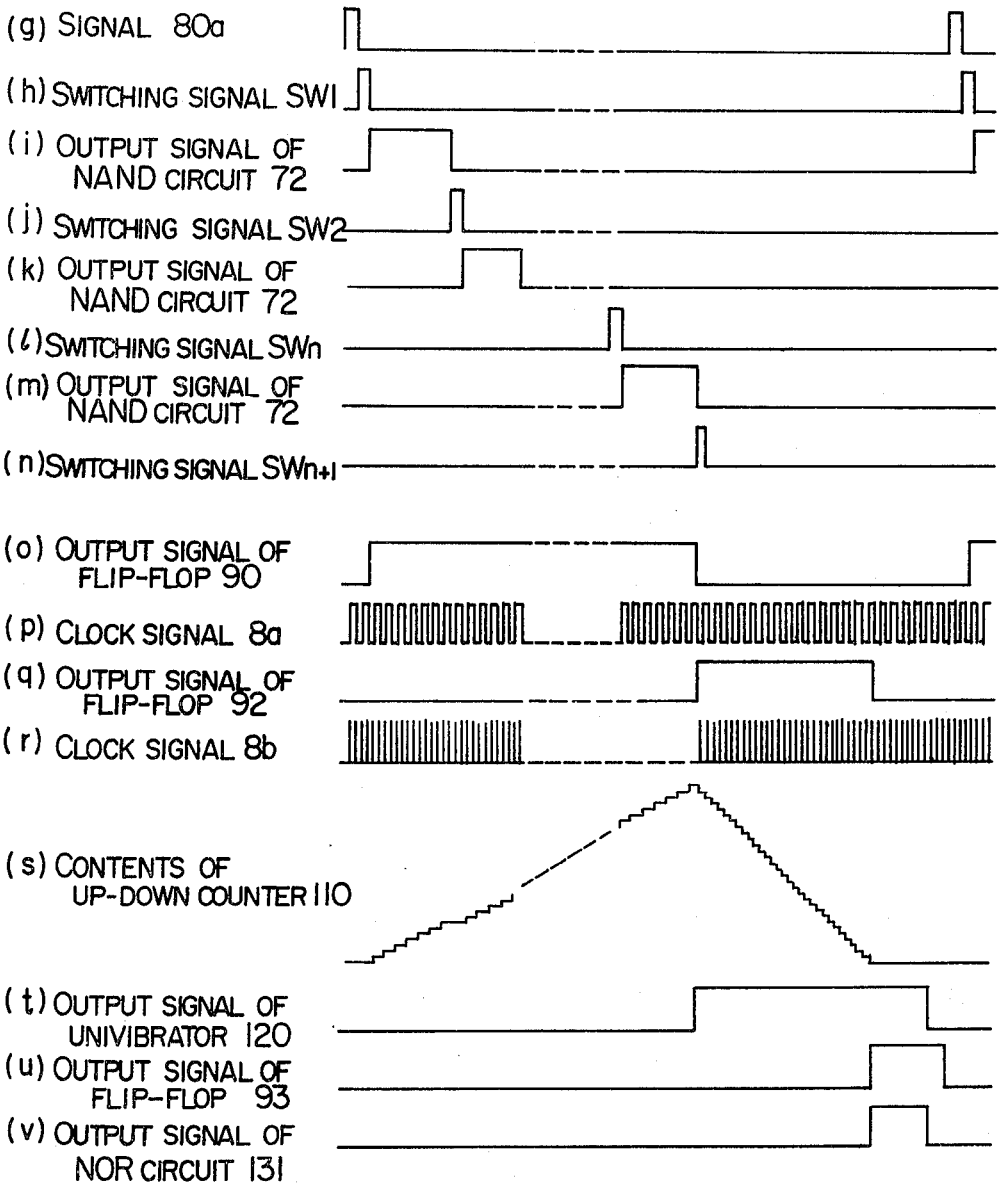
Figure 6:
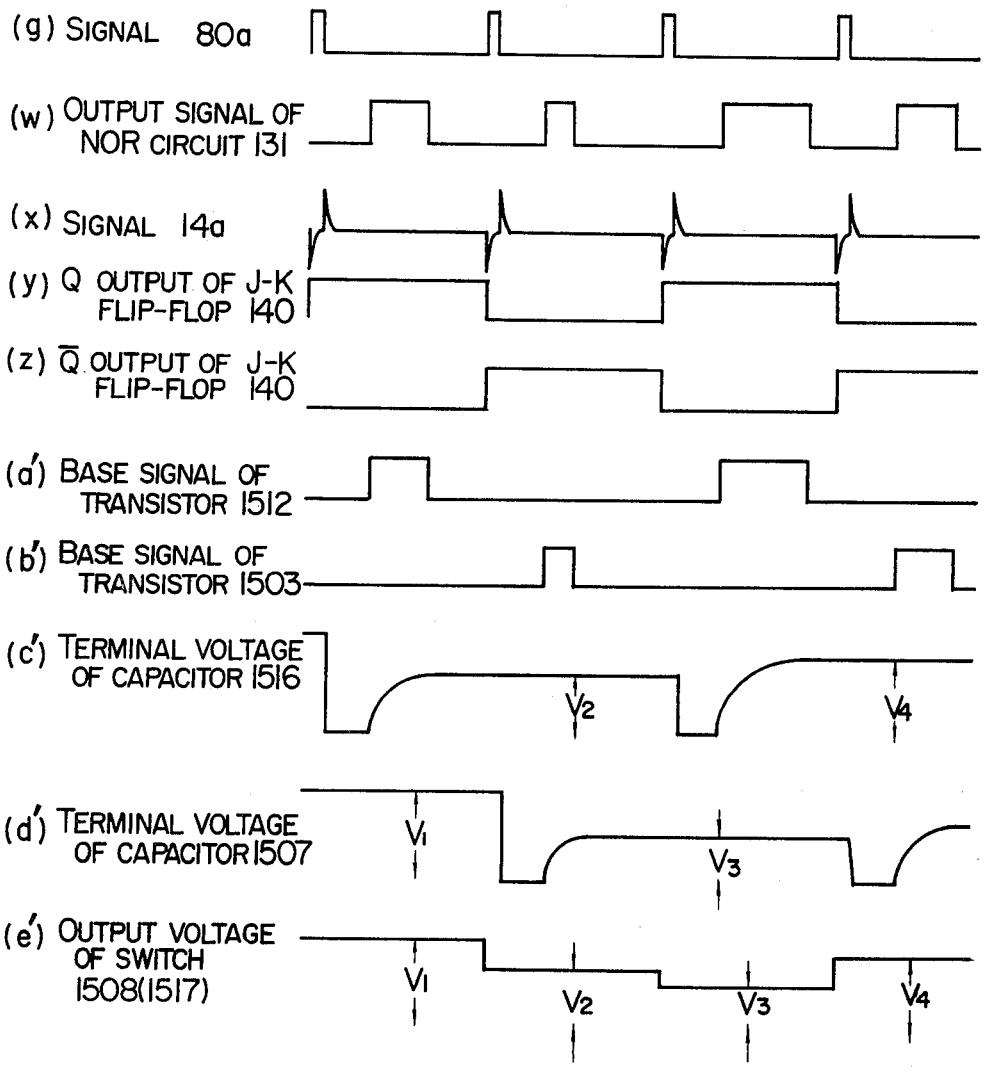

FIG. 4 is an operating waveform diagram illustrating the time relations among a voltage transforming circuit, a logarithmic time creating circuit 4, a comparator circuit 5, a constant time width creating circuit 6 and a subtractor circuit 7 in FIG. 3;

FIG. 5 is an operating waveform diagram illustrating the time relations among a switching circuit 2, the subtractor circuit 7, a control circuit 8, a control circuit 9, an adder and subtractor circuit 11, a constant time width creating circuit 12 and a subtractor circuit 13 in FIG. 3; and FIG. 6 is an operating waveform diagram illustrating the time relations among the control circuit 8, the subtractor circuit 13, a distributor circuit 14 and a time-voltage transforming circuit 15 in FIG. 3.

Figure 1A:
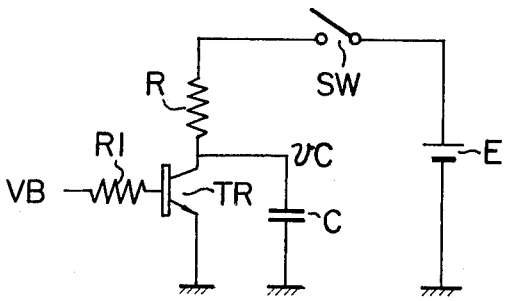
FIGS. 1A and 1B illustrate a concrete circuit and operating waveforms for elucidating the calculating principle according to this invention.

In a circuit of FIG. 1A, E designates a battery whose negative pole is grounded, SW a switch whose one end is connected to the battery, R a resistor which is connected to the other end of the switch SW, C a capacitor whose one end is connected to the resistor R and whose other end is grounded, TR an n-p-n transistor whose collector is connected to one end of the resistor R and whose emitter is grounded, and $R_1$ a resistor which is connected to the base of the n-p-n transistor TR.

Figure 1B:
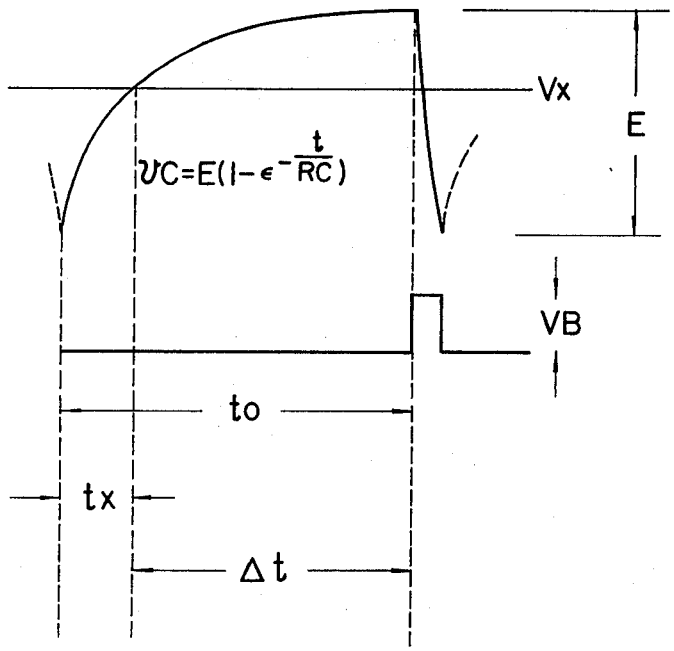

When the transistor TR in the circuit of FIG. 1A is "off", the terminal voltage VC of the capacitor C varies is in FIG. 1B. The terminal voltage VC at this time becomes as in the following equation:

$$VC = E\left(1 - \epsilon - \frac{t}{RC}\right) \tag{1}$$

Accordingly, the period of time $t_x$ in which the voltage variation expressed by Eq. (1) becomes $V_x$ is as in the following equation:

$$t_x = RC\ln\left(\frac{E}{E - V_x}\right) RC\ln E - RC\ln(E - V_x) \tag{2}$$

Here, putting $t_o = RC\ln E$, $(t_o - t_x)$ is expressed as in the following equation:

$$t_o - t_x = \Delta t = RC\ln E - \{RC\ln E - RC\ln(E - V_x)\} = RC\ln(E - V_x) \tag{3}$$

From Eq. (3), therefore, the time difference $\Delta t$ is porportional to $\ln(E - V_x)$.

Now, letting $\Delta t_1, \Delta t_2, \ldots \Delta t_n$ denote time differences made by $n$ voltage variations $V_{x1}, V_{x2}, \ldots V_{xn}$, they are respectively expressed by the following equations:

$$\Delta t_1 = RC\ln(E - V_{x1})\ \Delta t_2 = RC\ln(E - V_{x2})\ \Delta t_n = RC\ln(E - V_{xn}) \tag{4}$$

Accordingly, the sum of $\Delta t_1, \Delta t_2, \ldots \Delta t_n$ obtained by Eq. (4) is expressed as in the following equation:

$$\sum_{i=1}^{n} \Delta t_i = \Delta t_1 + \Delta t_2 + \ldots + \Delta t_n = RC\ln(E - V_{x1})(E - V_{x2})\ldots(E - V_{xn}) \tag{5}$$

When $\Sigma\Delta t_i$ obtained by Eq. (5) is considered as being $\Sigma\Delta t_i$ which is determined by still different values $R\alpha$ and $C\alpha$, it can be put as in the following equation:

$$\sum_{i=1}^{n} \Delta t_i = \Delta t\alpha = R\alpha C\alpha \ln(E\alpha - V_y) \tag{6}$$

In Eq. (6), $E\alpha$ may be made equal to E on the basis of the relations with $R\alpha$ and transformed by the final result of calculation.

Here, a period of time $t_o\alpha$ as represented by $t_o\ \alpha = R\alpha C\alpha ln\ E\alpha$ is created, and $\Delta t\alpha$ evaluated by Eq. (6) is subtracted from $t_o\alpha$. Then, $ty\alpha$ as in the following equation is obtained:

$$Ty\alpha = t_o\alpha - \Delta t\alpha = R\alpha C\alpha \ln E\alpha - R\alpha C\alpha \ln (E\alpha - V_y)$$

$$= R\alpha C\alpha \ln \left( \frac{E\alpha}{E\alpha - V_y} \right) \quad (7)$$

Accordingly, when the capacitor $C\alpha$ has been charged during the period of the time $ty\alpha$ obtained by Eq. (7), the terminal voltage $(E\alpha - V_y)$ of the capacitor $C\alpha$ becomes the value of the multiplication of the $n$ input voltages.

Therefore, by subtracting $(E\alpha - V_y)$ from the supply voltage $E$, the true value $V_y$ is evaluated.

Figure 2:
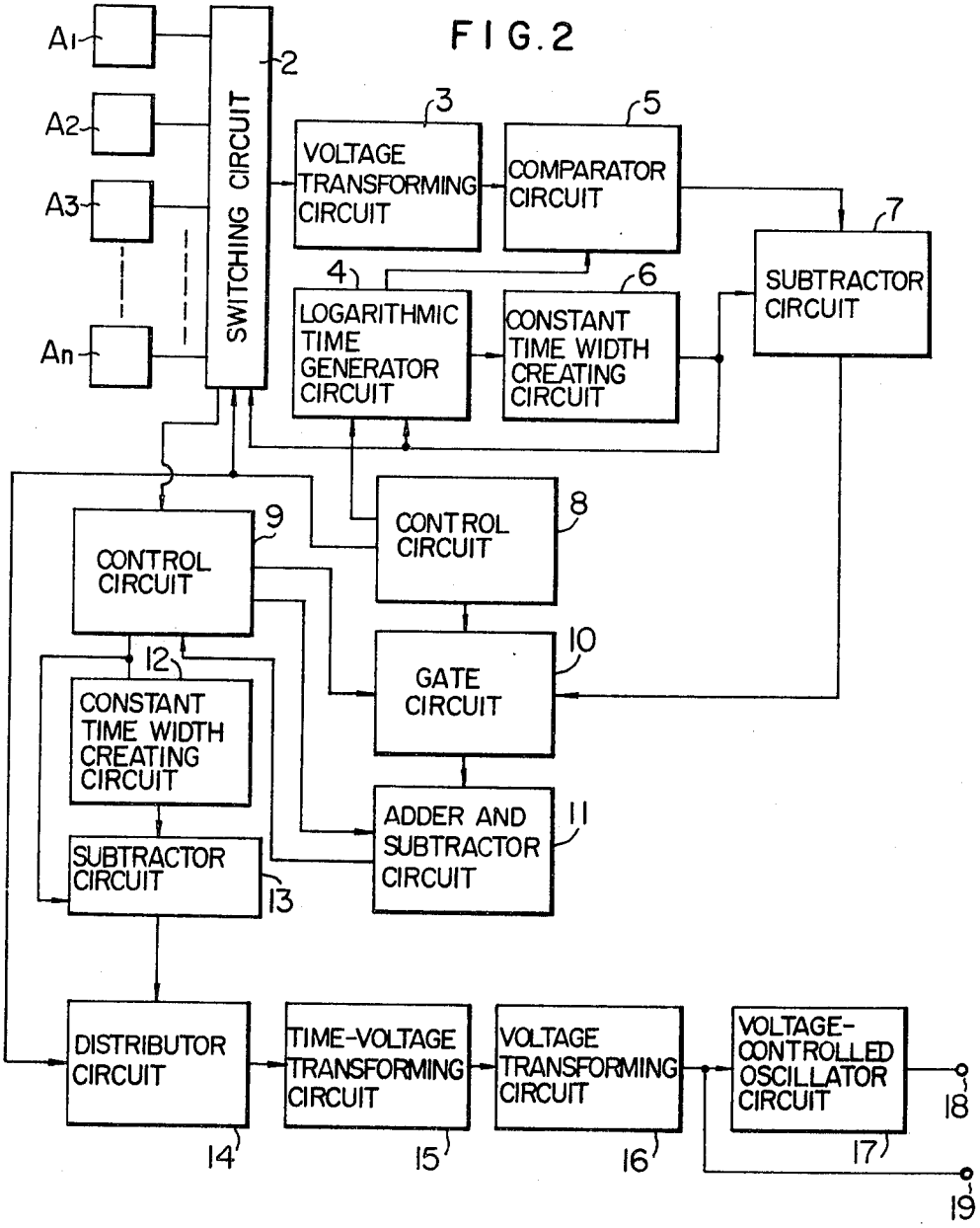
FIG. 2 is a block diagram showing an embodiment of this invention.

FIG. 2 is a block diagram showing an embodiment of this invention.

In FIG. 2, $A_1 - A_n$ designate $n$ voltage generators, which respectively supply as electric quantities to be multiplied, output voltages $V_{a1}, V_{a2}, \ldots V_{an}$ to become input voltages of the present multiplication unit. These voltage generators are, for example, sensors for measuring an air pressure, an atmospheric temperature and a temperature of an engine etc. when the present invention is applied to the fuel injecting means. Numeral 2 indicates a switching circuit which switches respective inputs in order to sequentially load the respective input voltages from the voltage generators $A_1 - A_n$; numeral 3 a voltage transforming circuit which subjects to voltage transformation each input voltage selected by the switching circuit 2; numeral 4 a logarithmic time generator circuit for making a pulse each time the switching circuit 2 is changed over, each pulse having a time period which is in a logarithmic relationship with the input voltage, for example, a logarithmic time creating circuit which initiates the charging of a capacitor to generate a period of time having a logarithmic relation to the voltage variation thereof; numeral 5 a comparator circuit which compares the input voltage selected by the switching circuit 2 and the output voltage of the logarithmic time creating circuit 4; numeral 6 a constant time width creating circuit which creates a certain fixed time width upon detecting the output voltage of the logarithmic time creating circuit 4; numeral 7 a subtractor circuit which serves to subtract the time width of an output signal of the comparator circuit 5 from the output time width of the constant time width creating circuit 6; numeral 8 a control circuit which creates a start signal of the unit of this invention and a clock signal for determining the accuracy; numeral 9 a control circuit which controls the output signals of the control circuit 8 by the output signals of the switching circuit 2 and which controls output signals to be stated later; numeral 10 a gate circuit which is enabled and disabled by the output of the subtractor circuit 7 and that of the control circuit 9, to control the clock signal delivered from the control circuit 8; numeral 11 an adder and subtractor circuit which subjects to addition and subtraction the clock signals having passed through the gate circuit 10; numeral 12 a constant time width creating circuit which creates a certain fixed time width on the basis of a signal delivered from the control circuit 9 upon detecting the fact that the contents of the adder and subtractor circuit 11 have become zero; numeral 13 a subtractor circuit which serves to subtract the output signal time width of the control circuit 9 from the output time width of the constant time width creating circuit 12; numeral 14 a distributor circuit which serves to distribute the output signal of the subtractor circuit 13 by the start signal of the control circuit 8; and numeral 15 a time-voltage transforming circuit which has two charging systems and which charges the charging system, selected by the distributor circuit 14, for the output signal time width of the subtractor circuit 13 to thereby transform the time width into a voltage, the output voltage of the time-voltage transforming circuit 15 being a value resultant from the multiplication of the respective output voltages of the voltage transforming circuit 3. Numeral 16 indicates a voltage transforming circuit for further subtracting the output voltage of the time-voltage transforming circuit 15 from a supply voltage. Numeral 17 denotes a control signal generator which generates a different kind of control signal according to the magnitude of the output voltage of the time-voltage transforming circuit 15, for example, a voltage-controlled oscillator circuit which generates a frequency corresponding to a voltage input. Numeral 18 represents terminal for outputting the signal of the voltage-controlled oscillator circuit 17, and numeral 19 is terminal for outputting the voltage which is obtained by multiplication of all the inputs from the time-voltage transforming circuit 15.

FIG. 3 shows an embodiment of this invention.

In the figure, E designates power supply terminals which are connected to batteries with their negative poles grounded. $A_1 - A_n$ indicate $n$ voltage generators or sensor S, and they respectively provide as outputs, voltage $V_{al} - V_{an}$ equivalent to values desired to be multiplied. Blocks $S_1 - S_n$ and 21 serve as a switching circuit 2.

The parts $S_1 - S_n$ are switches for sequentially loading the respective output voltages $V_{al} - V_{an}$ of the voltage generators $A_1 - A_n$, and all the output ends of the switches $S_1 - S_n$ are connected. The part 21 is a switching control circuit which provides switching signals of the switches $S_1 - S_n$ and consists of, for example, a shift registor The operation of this circuit is as follows:

When a start signal 80*a* for the unit of the present embodiment is entered into the switching control circuit 21, the switch $S_1$ is selected. Thereafter, each time a control input 6*a* is entered into the switching control circuit 21, the switches $S_2 - S_n$ are sequentially changed-over. The number of the switches are required to be that of input terminals. By providing the switching circuit, however, a signal arithmetic portion becomes sufficient even for many inputs.

Parts 30 – 34 serve as a voltage transforming portion of a voltage transforming circuit 3.

The part 30 is a resistor whose one end is connected to the positive pole of the supply voltage, 31 a resistor whose one end is connected to the resistor 30 and whose other end is grounded, 32 a resistor whose one end is connected to a common terminal of the switches, 33 an operational amplifier whose plus terminal is connected to the other end of the resistor 30 and whose minus terminal is connected to the other end of the resistor 32, 34 a resistor whose one end is connected to the minus terminal of the operation amplifier 33 and whose other end is connected to an output terminal of the operational amplifier 33.

The operatnion of this circuit is as follows:

Letting $V_{ai}$ denote the input voltage selected by the switches $S_1 - S_n$, $V_{out}$ and $V_-$ denote the output voltage and the minus input terminal voltage of the operational amplifier 33, respectively, and $R_{32}$ and $R_{34}$ denote the resistances of the resistors 32 and 34, respectively, the following equation holds:

$$\frac{V_{ai} - V_-}{R_{32}} = \frac{V_- - V_{out}}{R_{34}} \tag{8}$$

From Eq. (8), $V_-$ becomes as in the following equation:

$$V_- = \frac{R_{32} \cdot V_{out} + R_{34} \cdot V_{ai}}{R_{32} + R_{34}} \tag{9}$$

On the other hand, letting $R_{30}$ and $R_{31}$ denote the resistances of the resistors 30 and 31, respectively, and $V_+$ the plus input terminal voltage on the plus input terminal side of the operational amplifier 33, the following equation holds:

$$V_+ = \frac{R_{31}}{R_{30} + R_{31}} \cdot E \tag{10}$$

Assuming from the condition of stability of the operational amplifier 33 that Eq. (9) and Eq. (10) are equal, the following equation is obtained:

$$\frac{R_{32} \cdot V_{out} + R_{34} \cdot V_{ai}}{R_{32} + R_{34}} = \frac{R_{31}}{R_{30} + R_{31}} \cdot E \tag{11}$$

Putting $R_{30} = R_{31} = R_{32} = R_{34}$ in Eq. (11), the output voltage $V_{out}$ of the operational amplifier 33 becomes as in the following equation:

$$V_{out} = E - V_{ai}$$

Therefore, the input voltages $V_{al} - V_{an}$ selected by the switches $S_1 - S_n$ are transformed into the difference voltages from the supply voltage by means of the voltage transforming circuit 3.

Parts 301 and 302 constitute a "zero" input detecting portion for the voltage transforming circuit 3.

The part 301 is a comparator whose minus input terminal is connected to the minus terminal of the operational amplifier 33 and whose plus input terminal is grounded, while the part 302 is a flip-flop whose set signal input terminal is connected to the output terminal of the comparator 301 and whose reset signal input terminal has the start signal 80*a* of the present unit entered thereinto.

The operation of this circuit is as follows:

When any of the input voltages fed in through the switches $S_1 - S_n$ is "zero", the output of the comparator 301 turns from a "low" level to a "high" level, and the flip-flop 302 is set to deliver the high level from its output terminal Q. When none of the input voltages is zero, the comparator 301 continues to deliver the output of the low level.

Parts 41 - 45 constitute a logarithmic time creating circuit.

The part 41 is a resistor whose one end is connected to the positive pole of the power supply, 42 an n-p-n transistor whose collector is connected to the other end of the resistor 41 and whose emitter is grounded, 43 a capacitor whose one end is connected to the collector of the transistor 42 and whose other end is grounded, 44 a resistor whose one end is connected to the base of the transistor 42, and 45 an OR circuit whose output is connected to the resistor 44.

The operation of this circuit is as follows:

In the absence of the output signal from the OR circuit 45, the transistor 42 falls into the off state, and the capacitor 43 is charged by a time constant which is determined by the resistance $R_{41}$ of the resistor 41 and the capacity $C_{43}$ of the capacitor 43. Putting $VC = VC_{42}$, $R = R_{41}$ and $C = C_{42}$, the terminal voltage $VC_{42}$ of the capacitor 43 at this time varies as in the foregoing equation (1). In the presence of the output signal from the OR circuit 45, the transistor 42 falls into the "on" state, and charges $Q_{43} = C_{43} \cdot VC_{43}$ having been stored in the capacitor 43 are discharged through the transistor 42. When the terminal voltage of the capacitor 43 exhibiting such variation is intercepted by an arbitrary level $V_x$ in the range of variation, the time variation at that time becomes as represented by Eq. (2). When the time variation is subtracted from the period of time $t_o = R_{41} C_{43} lnE$ in which the saturation state of the terminal voltage of the capacitor 43 or the supply voltage is reached, the time variation expressed by Eq. (3) is obtained. The time variation is proportional to the logarithmic variation of the voltage variation ($E = V_x$).

Numeral 5 indicates a comparator whose plus terminal is connected to the output terminal of the operational amplifier 33 and wose minus terminal is connected to one end of the capacitor 43.

This circuit compares the voltage obtained by transforming the input voltage $V_{ai}$ selected by the switch $S_1 - S_n$ into $(E - V_{ai})$ by means of the operational amplifier 33, with the terminal voltage of the capacitor 43 at the time when the transistor 42 is in the off state. When the output voltage of the operational amplifier 33 is greater than the terminal voltage, the output voltage of the comparator 5 becomes the supply voltage, while when the input voltage is smaller, the output voltage of the comparator 5 becomes the ground level.

Accordingly, $(E - V_x)$ expressed by Eq. (3) corresponds to the voltages $(E - V_{al})$ to $(E - V_{ax})$ which are delivered from the operational amplifier 33.

Therefore, the time variation $t_i$ for the voltage $V_{ai}$ which is received as the input by the $i$-th switch is expressed as in the following equation:

$$t_i = R_{41} C_{43} \{In\, E - In\, (E - V_{ai})\} \tag{12}$$

Parts 60 - 62 constitute a constant time width creating circuit 6.

The part 60 is a comparator whose minus terminal is connected to one end of the capacitor 43 and whose plus terminal is grounded, the part 61 is a univibrator whose input end is connected to the output end of the comparator 60, and the part 62 is an inverter which is connected to the input end of the univibrator 61.

The operation of this circuit is as follows:

Whenever the terminal voltage of the capacitor 43 is higher than the zero level, the comparator 60 delivers the ground level, and the univibrator 61 and the inverter 62 do not operate and provide no output. On the other hand, when the terminal voltage of the capacitor 43 becomes the zero level, the comparator 60 changes from the ground level to the supply voltage level, and a certain fixed time width is delivered as an output from the univibrator 61. The time width is one equivalent to $t_o$ in FIG. 3(*b*). The output 6*a* of the inverter 62 is a signal with the output signal of the univibrator 61 inverted.

Parts 70 – 72 constitute a subtractor circuit 7.

The part 70 is a NAND circuit whose one input end is connected to the output end of the comparator 5 and whose other input end is connected to the output end of the univibrator 61, the part 71 is an inverter whose input end is connected to the output end of the NAND circuit 70, and the part 72 is a NAND circuit whose one input end is connected to the output end of the inverter 71 and whose other input end is connected to the output end of the univibrator 61.

The operation of this circuit is as follows:

The NAND circuit 70 detects the period of time during which the output of the comparator 5 is at the high level and the period of time during which the output of the univibrator 61 is at the high level. Further, the NAND circuit 72 creates the time width of the difference between such period of time and the period of time during which both the outputs of the comparator 5 and the univibrator 61 are at the high level.

Operating waveforms in the construction of the voltage transforming circuit 3, logarithmic time creating circuit 4, comparator circuit 5, constant time width creating circuit 6 and subtractor circuit 7 as thus far described are shown in FIGS. 4(*c*) – (*f*). FIG. 4(*c*) illustrates the relation between the output voltage $V_{out33}$ of the operational amplifier 33 obtained by subjecting to the voltage transformation the input voltage $V_{in}$ selected by the switch and the output voltage $VC_{43}$ of the logarithmic time creating circuit 4. FIG. 4(*d*) illustrates the output signal of the comparator 5 of the comparator circuit which detects the relation of magnitude between the output voltage $V_{out33}$ of the operational amplifier 33 and the output voltage of the logarithmic time creating circuit 4, and the high level is delivered during the period during which the output voltage $V_{out33}$ is greater than the output voltage of the logarithmic time creating circuit 4. FIG. 4(*e*) illustrates the output signal of the univibrator 61 of the constant time creating circuit 6 which creates the fixed time width upon detecting that the output voltage of the logarithmic time creating circuit 4 is zero. The fixed time width is determined by the supply voltage and the resistor $R_{41}$ as well as the capacitor $C_{43}$ employed in the logarithmic time creating circuit 4. FIG. 4(*f*) illustrates the output signal of the subtractor circuit 7 which subtracts the output signal width of the comparator 5 illustrated in FIG. 4(*d*) from the output signal time width of the constant time width creating circuit 6.

A part 8 is a control circuit which produces a start signal 90*a* of the present unit and clock signals 8*a* and 8*b* determining the operation accuracy. 8*a* designates the clock signal to be used for the addition operation, while 8*b* indicates the clock signal to be used for the subtraction operation. The clock signals 8*a* and 8*b* may well be the same.

Parts 90 – 93 constitute a control circuit 9.

The part 90 is a flip-flop whose set terminal is connected to the first switching signal end of the switching control circuit 21 and whose reset terminal is connected to the ($n$ + 1-th switching signal end, the part 91 is an inverter which is connected to the Q output terminal of the flip-flop 90, the part 92 is a flip-flop whose set terminal is connected to the output end of the inverter 91 and which receives a signal 111*a* as an input to its reset terminal, and the part 93 is a flip-flop which receives the signal 111*a* as an input to its set terminal and whose reset terminal is connected to the Q output terminal of the flip-flop 90.

The operation of this circuit is as follows:

When the first switching signal of the switching control circuit 21 is delivered, the flip-flop 90 is set and the Q output terminal becomes the high level. At this time, the flip-flop 93 is simultaneously reset. When the ($n$ + 1)-th switching signal which is provided after all the inputs have been received is delivered from the switching control circuit 21, the flip-flop 90 is reset and the Q output terminal becomes the low level. At this time, the flip-flop 92 is simultaneously set.

When the signal 111*a* is entered the flip-flop 92 is reset and the flip-flop 93 is set.

Parts 100 – 102 constitute a gate circuit.

The part 100 is a NAND circuit whose one input terminal is connected to the output end of the NAND circuit 72 and whose other input terminal is connected to the output terminal of the control circuit 8 for the clock signal 8*a,* the part 101 is a NAND circuit whose one input terminal is connected to the Q output terminal of the flip-flop 92 and whose other input terminal is connected to the output terminal of the control circuit 8 for the clock signal 8*b,* and the part 102 is a NAND circuit whose one input terminal is connected to the output terminal of the NAND circuit 100 and whose other input terminal is connected to the output terminal of the NAND circuit 101.

The operation of this circuit is as follows:

When the output of the NAND circuit 72 is at the high level, the NAND circuit 100 is opened and the clock signal 8*a* becomes the input signal of the NAND circuit 102. The gate circuit 10 is so controlled that when the NAND circuit 100 is "opened", the NAND circuit 101 becomes "closed". Therefore, when the clock signal of the NAND circuit 101 is at the high level. Accordingly, the NAND circuit 102 becomes the opened state, and the clock signal 82 is delivered from the NAND circuit 102. Likewise, when the output of the flip-flop 92 is at the high level, the NAND circuit 101 is opened, the clock signal 8*b* becomes the input signal of the NAND circuit 102, and the clock signal 8*b* is delivered from the NAND circuit 102.

Parts 110 and 111 constitute an adder and subtractor circuit.

The part 110 is an up-down counter whose countable selective terminal receives the start signal 80*a,* whose clock signal input terminal is connected to the output end of the NAND circuit 102 and whose addition and subtraction control terminal is connected to the Q output end of the flip-flop 90. The part 111 is a NOR circuit whose input terminals are respectively connected to the output terminals of the up-down counter 110, and which delivers the output signal 111*a.*

The operation of this circuit is as follows:

When the Q output terminal of the flip-flop 90 is at the high level after the start signal 80*a* has been received into the up-down counter 110, that is, during the period from the delivery of the first switching signal of the switching circuit 2 till the reception of the ($n$ + 1)-th switching signal which is delivered after all the switches have been switched, the up-down counter adds according to the clock signals which are received as inputs. The count number obtained at this time represents $$\sum_{i=1}^{n} \Delta t_i$$

given by Eq. (5). When the output terminal of the flip-flop 90 is at the low level, that is, during the period from the delivery of the $(n + 1)$-th switching signal, the up-down counter 110 subtracts according to the clock signals which are received as inputs. Accordingly, the period of time in which the contents of the up-down counter 110 become zero after the change-over from the addition to the subtraction expresses Eq. (6). While, after initiating the addition count by the output signal of the flip-flop 90, the up-down counter 110 is delivering the signal to any of the output signals, the NOR circuit provides no output signal. However, when the up-down counter 110 falls into the state of the subtraction count and all the output terminals become zero, the high level signal is provided.

A part 120 is a univibrator which constructs a constant time width creating circuit and whose input terminal is connected to the $\overline{Q}$ output terminal of the flip-flop 90. The univibrator 120 provides a certain fixed time width when the $(n + 1)$-th switching signal of the switching circuit 2 is delivered and the $\overline{Q}$ output terminal input of the flip-flop 90 becomes the high level. The time width is one equivalent to $t_o'$ in Eq. (7).

Parts 130 – 133 constitute a subtractor circuit 13.

The part 130 is a NAND circuit whose one input end is connected to the Q output terminal of the flip-flop 93 and whose other input end is connected to the output end of the univibrator 120, the part 131 is a NOR circuit whose one input end is connected to the output end of the NAND circuit 130 and whose other input end is connected to the Q output terminal of the flip-flop 302, the part 132 is a NAND circuit whose one input end is connected to the NOR circuit 131 and whose other input end is connected to the Q output terminal of the flip-flop 302, and the part 133 is a NAND circuit whose one input end is connected to the output end of the NAND circuit 132 and whose other input end is connected to the Q output terminal of the flip-flop 302.

The operation of this circuit is as follows:

After the $(n + 1)$-th switching signal is received into the flip-flop 90, the fixed time width is delivered from the constant time width creating circuit 120. When the signal 111*a* which signified that after the delivery of the signal of the fixed time width the output of the up-down counter has become zero due to the subtraction is received into the flip-flop 93, the high level is delivered from the flip-flop 93. The NAND circuit 130 detects the period of time during which both the output signal of the constant time width creating circuit 120 and the output signal of the flip-flop 93 are at the high level, that is, the time width of the difference between the two signals. The signal of the time width is delivered through the NOR circuit 131 and the NAND circuits 132 and 133 when the Q output terminal of the flip-flop 302 is at the low level and the $\overline{Q}$ output terminal is at the high level. Where one of the inputs is zero, the Q output terminal of the flip-flop 302 becomes the high level, and hence, the NOR circuit 131 becomes closed so that the time width is not delivered. At this time, however, while the $\overline{Q}$ output terminal of the flip-flop 302 is at the high level, the high level is delivered from the NAND circuit 133. Operating waveforms in the construction from the operation of the switching circuit 2 to the obtainment of the output from the subtractor circuit 13 are shown in FIGS. 5(*g*) – (*w*). FIG. 5(*g*) shows the start signal of the present unit as delivered from the control circuit 81, FIG. 5(*h*) the first switching signal $Sw_1$ delivered from the switching circuit 2, and FIG. 5(*i*) the time width which is obtained in such a way that the time width acquired by the switching signal $Sw_1$ is subtracted from the fixed time width acquired by the univibrator 61. FIGS. 5(*j*) and (*k*) show the second switching signal $Sw_2$ which is delivered from the switching circuit 2, and the time width which is obtained by operating by the subtractor circuit 13 the time width acquired by $Sw_2$, respectively. FIGS. 5(*l*) and (*m*) similarly represent the *n*-th switching signal $Sw_n$ and the output signal of the subtractor circuit 7, respectively. FIG. 5(*n*) illustrates the $(n + 1)$-th switching signal which is delivered from the switching circuit 2, after the output signal of the subtractor circuit 7 for the *n*-th input voltage $V_{an}$ has been established. FIG. 5(*o*) illustrates the Q output terminal signal of the flip-flop 90 which is reset by the $(n + 1)$-th switching signal $Sw_{n+1}$, the illustrated signal being the up (addition) signal of the up-down counter 110. FIG. 5(*p*) illustrates the clock signal 8*a* which is used when the up-down counter 110 is in the state of addition. FIG. 5(*q*) illustrates the Q terminal output signal of the flip-flop 92 which is set by the change of the Q terminal output signal of the flip-flop 90 and which is reset when the contents of the adder and subtractor circuit 110 or all the output signals thereof have become zero. FIG. 5(*r*) illustrates the clock signal 8*b* which is used when the up-down counter 110 is in the state of subtraction. FIG. 5(*s*) represents the variation of the count contents of the up-down counter 110 which counts the clock signals 8*a* when the NAND circuit 100 of the gate circuit 9 is opened and which counts the clock signals 8*b* when the NAND circuit 101 of the gate circuit 9 is opened. FIG. 5(*t*) illustrates the constant time width signal which is delivered from the univibrator 120 upon the reception of the $(n + 1)$-th switching signal $Sw_{n+1}$. FIG. 5(*u*) illustrates the Q terminal output signal of the flip-flop 93 which is set when all the contents of the up-down counter 110 become zero and which is reset by the Q terminal output signal of the flip-flop 90. FIG. 5(*v*) represents the time width which is the output signal of the subtractor circuit 13 and which is obtained by subtracting the output signal of the flip-flop 93 from the output signal of the univibrator 120.

Parts 140 – 145 constitute a distributor circuit.

The part 140 is a J-K flip-flop whose clock signal input terminal is connected to the start signal output terminal of the control circuit 8, the part 141 an inverter whose input end is connected to the clock signal input end of the J-K flip-flop 140, the part 142 a capacitor whose one end is connected to the output terminal of the inverter 141, the part 143 a resistor whose one end is connected to the other end of the capacitor 142 and whose other end is grounded, the part 144 a NOR circuit whose one input terminal is connected to the Q output terminal of the J-K flip-flop 140 and whose other input terminal is connected to the output terminal of the NAND circuit 130, and the part 145 is a NOR circuit whose one input terminal is connected to the $\overline{Q}$ output terminal of the J-K flip-flop 140 and whose other input terminal is connected to the output terminal of the NAND circuit 130.

The operation of this circuit is as follows:

When the start signal 80a is received as an input, the Q output terminal of the J-K flip-flop 140 becomes the high level and the $\overline{Q}$ output terminal becomes the low level. When, under this state, the output signal of the NAND circuit 130 is at the low level, the output signal of the NOR circuit 144 becomes the low level and that of the NOR circuit 145 becomes the high level.

On the other hand, the start signal 80a is inverted by the inverter 141, and the output signal of the inverter 141 charges the capacitor 142 instantly at the point of the change from the low level to the high level. When the output signal of the inverter 141 is stabilized to the high level, charges having been stored in the capacitor 142 are discharged according to a time constant which is determined by the capacity of the capacitor 142 and the resistance of the resistor 143, and the terminal voltage of the resistor 143 becomes a differentiation signal.

Parts 1500 - 1517 constitute a time — voltage transforming circuit 15.

The part 1500 is a switch whose input end is connected through the NAND circuits 132 and 133 to the NOR circuit 131 and whose switching control terminal is connected to the output end of the NOR circuit 144, the part 1501 is a resistor which is connected to the output end of the switch 1500, the part 1502 is a resistor whose one end is connected to the power supply anode E, the part 1503 is an n-p-n transistor whose base terminal is connected to the other end of the resistor 1501 and whose collector terminal is connected to the other end of the resistor 1502, the part 1504 is a switch whose input end is connected to the capacitor 142 and whose switching control terminal is connected to the Q output terminal of the J-K flip-flop 140, the part 1505 is a resistor which is connected to the output end of the switch 1504, the part 1506 is an n-p-n transistor whose base end is connected to the resistor 1505, whose collector end is connected to the emitter is grounded, the part 1507 is a capacitor whose one end is connected to the collector end of the n-p-n transistor 1506 and whose other end is grounded, and the part 1508 is a switch whose input end is connected to one end of the capacitor 1507 and whose switching control terminal is connected to the Q output terminal of the J-K flip-flop 140.

The part 1509 is a switch whose input end is connected through the NAND gates 132 and 133 to the NOR circuit 131 and whose switching control terminal is connected to the output end of the NOR circuit 145, the part 1510 is a resistor which is connected to the output end of the switch 1509, the part 1511 is a resistor whose one end is connected to the power supply anode E, the part 1512 is an n-p-n transistor whose base end is connected to the other end of the resistor 1510 and whose collector end is connected to the other end of the resistor 1511, the part 1513 is a switch whose input end is connected to the capacitor 142 and whose switching control terminal is connected to the Q output terminal of the J-K flip-flop 140, the part 1514 is a resistor whose one end is connected to the output end of the switch 1513, the part 1515 is an n-p-n transistor whose base end is connected to the resistor 1514, whose collector end is connected to the emitter end of the n-p-n transistor 1512 and whose emitter end is grounded, the part 1516 is a capacitor whose one end is connected to the collector end of the n-p-n transistor 1515 and whose other end is grounded, and the part 1517 is a switch whose input end is connected to one end of the capacitor 1516, whose switching control terminal is connected to the $\overline{Q}$ output terminal of the J-K flip-flop 140 and whose output terminal is connected to the output terminal of the switch 1508.

The parts 1500 - 1508 and 1509 - 1517 have the same function, and alternately operate through the selection of the respective switches.

The operation of this circuit is as follows:

When the Q output terminal of the flip-flop 140 is at the high level and the $\overline{Q}$ output terminal is at the low level, the switches 1508 and 1513 become closed and the switches 1504 and 1517 become opened. When, at this time, the start signal 80a is entered into the inverter 141, the differentiation signal 14a is prepared at the fall point of the start signal 80a by the capacitor 142 and the resistor 143, and charges having been accumulated in the capacitor 1516 are instantly discharged through the transistor 1515.

Subsequently, when under the same state of the flip-flop 140 the output of the NAND circuit 130 becomes the low level, the low level and high level are respectively delivered from the NOR circuits 144 and 145, and the switch 1504 becomes opened and the switch 1509 closed. Accordingly, when the output of the NOR circuit 131 becomes the high level under the nonconductive state of the transistor 1515, the transistor 1512 becomes conductive, and the capacitor 1516 is charged. At this time, letting $t_{v1}$ denote the period of time during which the output of the NOR circuit 131 is at the high level, $r_1$ denote the resistance of the resistor 1511 and $C_{o1}$ denote the capacity of the capacitor the terminal voltage $V_{c1516}$ of the capacitor 1516 becomes as in the following equations:

$$V_{c1516} = E\left(1 - \epsilon - \frac{t_{v1}}{r_1 C_{o1}}\right) \tag{13}$$

Since the switch 1517 is opened at this time, the voltage $V_{c1516}$ given by Eq. (13) does not appear at the output terminal of the switch 1517.

Subsequently, when the Q output terminal of the flip-flop 140 becomes the low level and the $\overline{Q}$ output terminal the high level, the switch 1517 becomes closed, so that the terminal voltage $V_{c1516}$ of the capacitor 1516 appears at the output terminal of the switch 1517.

On the other hand, when the output of the NOR circuit 131 becomes the high level under the nonconductive state of the transistor 1506, the transistor 1503 is rendered conductive and the capacitor 1507 is charged. At this time, letting $t_{v2}$ denote the period of time during which the output of the NOR circuit 131 is at the high level, $r_2$ denote the resistance of the resistor 1502 and $C_{02}$ denote the capacity of the capacitor, the terminal voltage $V_{c1507}$ of the capacitor 1507 becomes as in the following equation likewise to Eq. (13):

$$V_{c1507} = E\left(1 - \epsilon - \frac{t_{v2}}{r_2 C_{o2}}\right) \tag{14}$$

Similarly to the previous case, the voltage $V_{c1507}$ given by Eq. (14) is delivered to the output end of the switch 1508 when this switch is closed.

On the basis of the foregoing, the capacitors 1507 and 1516 operate alternately upon the arrival of the start signal 80a, and the control signals of the switches 1508 and 1517 represent the variation of the capacitor terminal voltages.

FIGS. 6(g) - (e') show a time chart of the operation of the time — voltage transforming circuit. FIG. 6(g) illustrates the start signal of the present unit as delivered from the control circuit (1) - 8. FIG. 6(w) illustrates the output signal of the NOR circuit 131 of the subtractor circuit 13, in which the time width of the high level is acquired by operating all the inputs. FIG. 6(x) illustrates the signal which is acquired by differentiating the start signal 80a by means of the capacitor 142 and the resistor 143 and which discharges the charges accumulated in the capacitors 1507 and 1516. FIGS. 6(y) and (z) illustrate the Q output terminal signal and the $\overline{Q}$ output terminal signal of the J-K flip-flop 140 which is operated by the start signal 80a, respectively. FIG. 6(a') illustrates the signal which is impressed on the base end of the transistor 1512 when the Q output terminal of the J-K flip-flop 140 is at the high level, while FIG. 6(b') illustrates the signal which is impressed on the base of the transistor 1503 when the $\overline{Q}$ output terminal of the J-K flip-flop 140 is at the high level. FIG. 6(c') represents the voltage variation of the capacitor 1517 at the time when the transistor 1512 is in the nonconductive state and the conductive state owing to the signal of FIG. 6(x) and the signal of FIG. 6(a'), while FIG. 6(d') represents the voltage variation of the capacitor 1507 at the time when the transistor 1503 is in the nonconductive state and when the conductive state owing to the signal of FIG. 6(x) and the signal of FIG. 6(b'). FIG. 6(e') represents the output voltage of the time-voltage transforming circuit 15 as produced by the alternate voltage transforming circuit 15 as produced by the alternate change-over of the switches 1508 and 1517 from the voltages (for example, $V_1$ - $V_4$) which are obtained when the transistors 1517 and 1503 are respectively in the conductive state in FIGS. 6(c') and (d').

Parts 160 - 164 constitute a voltage transforming circuit.

The part 160 is a resistor whose one end is connected to the anode of the supply voltage E, the part 161 is a resistor whose one end is connected to the resistor 160 and whose other end is grounded, the part 162 is a resistor whose one end is connected to the switch 1508 of the time-voltage transforming circuit 15, the part 163 is an operational amplifier whose plus terminal is connected to one end of the resistor 160 and whose minus terminal is connected to the other end of the resistor 162, and the part 164 is a resistor whose one end is connected to the minus terminal of the operational amplifier 163 and whose other end is connected to the output terminal of the operational amplifier 163.

The function of this circuit is to evaluate from the voltage $(E - v_y)$ expressed by Eq. (7) previously stated, the quantity $v_y$ which is the value resultant from the multiplication of all the input voltages.

The operation of this circuit is as follows:

Letting the output voltages of the switches 1508 and 1517 be $(E - v_y)$ and the output voltage and minus input terminal voltage of the operational amplifier 163 be $v_{163}$ and $v_{-163}$, respectively, and assuming all the resistances of the resistors 160 - 162 and 164 to be equal, the voltage $v_{-163}$ becomes as given by the following equation:

$$v_{-163} = \{ v_{163} + (E - v_y)\} /2 \quad (15)$$

On the other hand, the plus input terminal voltage of the operational amplifier 163 as represented by $v_{+163}$ becomes as given by the following equation:

$$v_{-163} = E/2 \quad (16)$$

Putting from the condition of stability of the operational amplifier that Eqs. (15) and (16) are equal, the output voltage $v_{163}$ of the operational amplifier 163 becomes as in the following equation:

$$v_{163} = E - (E - v_y) = v_y \quad (17)$$

Numeral 17 designates a voltage-controlled oscillator whose input terminal is connected to the output terminal of the operational amplifier 163 of the voltage transforming circuit 16 and which delivers an oscillation frequency as its output in accordance with the magnitude of the output voltage of the voltage transforming circuit 16.

Numeral 18 denotes an output terminal for the output signal of the voltage-controlled oscillator 17, which provides a frequency responsive to the input voltage.

Numeral 19 indicates a terminal which provides the voltage of the multiplication result obtained by the present unit.

With the multiplication circuit described above, effects to be stated below are attained.

In the prior-art multi-input multiplication system employing a plurality of multipliers, $(n - 1)$ multipliers of complicated construction are required for $n$ inputs. In contrast, according to this invention, the multiplication of many inputs is enabled by at least one arithmetic circuit irrespective of the number of inputs, and the number of components of the whole unit may be small.

According to the embodiment of FIGS. 4 and 5, low cost, miniaturization and high reliability are realizable because, whereas the prior-art system becomes very costly with increase in the number of inputs on account of the high cost of the individual multipliers, this invention enables the multiplication even with the single arithmetic circuit.

This invention provides a circuit arrangement for executing the multiplication of a plurality of analog input voltages.

This invention is a very effective expedient which is applicable in case where the multiplication is necessary in the fields of instrumentation, control etc. In particular, since the fuel injection rate of an internal combustion engine is expressed in the form of the product of a plurality of parameters, the unit of this invention is conveniently used as a device for controlling the fuel injection time, for example, a device in which is order to correct the width of a pulse for the fuel injection in dependence on the atmospheric pressure, the atmospheric temperature and the engine temperature, outputs from sensors for these quantities are subjected to multiplication processing.

The embodiment includes means to discriminate whether or not each of the input quantities to be multiplied is zero, and when at least one of the input quantities is zero, the output of the unit becomes zero. If such means is not disposed, a multiplication value for those of the input quantities which are not zero will be obtained.

What is claimed is:

1. Multiplication apparatus comprising:

a plurality of input means each receiving an input analog signal to be multiplied;

a first means for producing a first pulse in response to said input signal to thereby convert said plurality of input signals into a plurality of first pulses, said first pulse having a time width in logarithmic relation with the analog value of said input analog signal;

a switching means having switches connected between said plurality of input means and said first means, said switches being changed-over one by one sequentially in predetermined order to thereby conduct said input analog signals to said first means one by one sequentially;

a second means for producing a train of pulses in response to said first pulse to thereby convert said plurality of first pulses into a plural train of pulses, said train of pulses having a predetermined period and being produced while said first pulse is applied thereto;

a counter means for counting up the number of pulses of said plural trains of pulses which are supplied from said second means in accordance with said predetermined order;

a third means for producing a second pulse having a time width corresponding to the contents of said counter means; and a fourth means for converting said second pulse into a signal having a voltage which is in antilogarithmic relation with said time width of said second pulse.

2. Multiplication apparatus according to claim 1, wherein said fourth means is provided with a fifth means for subtracting said time width of said second pulse from a predetermined time width to thereby output a signal having a time width equal to the difference between said time width of said second pulse and said predetermined time width, and a sixth means for charging a first capacitor during the time equal to said time width of said output signal of said fifth means to thereby output the terminal voltage of said first capacitor.

3. Multiplication apparatus according to claim 2, wherein said first means is provided with a seventh means for subtracting said analog value of said input signal from a predetermined value to thereby output a signal having a value equal to the difference between said analog value of said input signal and said predetermined value, a second capacitor, a control means for controlling charge and discharge of said second capacitor, and a first detecting means for detecting the terminal voltage of said second capacitor, said first detecting means detecting a time required for said terminal voltage of said second capacitor to reach to said value of said output signal of said seventh means from the start of the charge thereof to thereby output a signal upon the detection of said time.

4. Multiplication apparatus according to claim 3, wherein said first means is further provided with a second detecting means for detecting the analog value of said input analog signals one by one whether they are zero level or not, and a holding means for holding the analog value of said input analog signal in response to the output of said second detecting means when said second detecting means detects that at least one of said input analog signals is zero level to thereby output zero level.

* * * * *